US010532868B2

(12) United States Patent
Wintz

(10) Patent No.: US 10,532,868 B2
(45) Date of Patent: Jan. 14, 2020

(54) TAG ASSEMBLY FOR RETAINING AND DISPLAYING PRODUCTS

(71) Applicant: Bedford Industries, Inc., Worthington, MN (US)

(72) Inventor: Trevor Wintz, Round Lake, MN (US)

(73) Assignee: Bedford Industries, Inc., Worthington, MN (US)

( * ) Notice: Subject to any disclaimer, the term of this patent is extended or adjusted under 35 U.S.C. 154(b) by 63 days.

(21) Appl. No.: 15/322,596

(22) PCT Filed: Jul. 1, 2015

(86) PCT No.: PCT/US2015/038822
§ 371 (c)(1),
(2) Date: Dec. 28, 2016

(87) PCT Pub. No.: WO2016/004199
PCT Pub. Date: Jan. 7, 2016

(65) Prior Publication Data

US 2017/0129673 A1 May 11, 2017

Related U.S. Application Data

(60) Provisional application No. 62/019,984, filed on Jul. 2, 2014.

(51) Int. Cl.
*B65D 5/20* (2006.01)
*B65D 5/42* (2006.01)
(Continued)

(52) U.S. Cl.
CPC ..... *B65D 73/0085* (2013.01); *B65D 23/003* (2013.01); *B65D 73/0064* (2013.01);
(Continued)

(58) Field of Classification Search
CPC .... B65D 71/44; B65D 71/40; B65D 71/0003; B65D 71/406; B65D 21/0204;
(Continued)

(56) References Cited

U.S. PATENT DOCUMENTS 1,144,086 A * 6/1915 Achenbach ..... G09F 3/04 40/310
1,702,199 A * 2/1929 Cunningham ..... A47G 23/065 229/932
(Continued)

FOREIGN PATENT DOCUMENTS

DE 9206386 U1 7/1992
DE 9402557 U1 7/1994
(Continued)

OTHER PUBLICATIONS

First Examination Report dated Jul. 7, 2017 for New Zealand Application No. 725019.
(Continued)

*Primary Examiner* — Gideon R Weinerth
(74) *Attorney, Agent, or Firm* — Mai-Tram D. Lauer Westman, Champlin & Koehler P.A.

(57) ABSTRACT

A tag assembly (10, 210, 310, 410) includes a tag panel (14, 314, 414) and a elastomer panel (16). The tag panel (14, 314, 414) includes a first panel segment (22*a*, 322*a*, 422*a*) and a second panel segment (22*b*, 322*b*, 422*b*) demarcated from the first panel segment (22*a*, 322*a*, 422*a*) by a first fold line (48*a*, 348*a*). The second panel segment (22*b*, 322*b*, 422*b*) includes a panel aperture (34) and a plurality of slits (36, 236) communicating with the panel aperture (34) and defining a plurality of tabs (38, 238) therebetween. A retention aperture (24, 52, 58) is positioned on and through the tag panel (14, 314, 414). The elastomer panel (16) is bonded to the second panel segment (22*b* 322*b* 422*b*) and comprises a stretchable aperture (44), wherein the stretchable aperture
(Continued)

(44) overlaps the panel aperture (34). A method for displaying a product (12) includes providing a tag assembly (10, 210, 310, 410), inserting a first portion (12*a*) of the product (12) through the stretchable aperture (44), inserting the first portion (12*a*) of the product (12) through the panel aperture (34), and restricting the first portion (12*a*) from withdrawing through the panel aperture (34) with the radially-separated tabs (38, 238) of the tag panel (14, 314, 414).

15 Claims, 13 Drawing Sheets

(51) Int. Cl.
*B65D 71/64* (2006.01)
*B65D 75/00* (2006.01)
*B65D 73/00* (2006.01)
*B65D 23/00* (2006.01)

(52) U.S. Cl.
CPC ..... *B65D 2571/0029* (2013.01); *B65D 2571/0066* (2013.01); *B65D 2571/00475* (2013.01)

(58) Field of Classification Search
CPC .... B65D 25/205; B65D 23/005; B65D 23/14; B65D 73/0064; B65D 73/00; B65D 2571/00728; B65D 2571/00734; B65D 2571/0074; B65D 71/00; B65D 5/5007; B65D 2571/0066; B65D 2571/00475; B65D 2571/00141; B65D 2571/0029; B65D 71/50; B65D 71/48; B65D 71/504; B65D 71/508; B65D 71/46; B65D 5/4208; B65D 5/4266; B65D 5/20; B65D 71/0048; B65D 71/0051; B65D 71/0055; B65D 71/0059; B65D 2571/00314; B65D 2571/00154; B65D 73/0085; G09F 1/06; G09F 1/04; A47G 23/0208; A47G 23/0216; A47G 23/0616; A47G 23/0641; A47F 5/0006; A47F 7/28; A47J 47/14; Y10S 206/806; Y10S 229/93; Y10S 229/931
USPC ..... 294/87.2, 163, 169, 165, 166, 31.2, 33, 294/34, 158, 159, 164, 117.14, 116, 294/117.09, 932; 248/224.8, 312; 215/395, 396, 399; 220/758, 763, 754, 220/737, 755; 211/74; 206/486, 161, 206/806, 476, 147, 194; 40/786, 310; 229/117.14, 117.22, 117.09, 103.2, 930
See application file for complete search history.

(56) References Cited

U.S. PATENT DOCUMENTS 1,910,168 A * 5/1933 Jacobs ..... A45F 5/10 294/142
1,982,276 A * 11/1934 West ..... B65D 23/104 294/152
1,995,280 A 3/1935 Everhart
2,054,641 A 9/1936 Stone
2,057,618 A 10/1936 Keith
2,227,780 A * 1/1941 Hickman ..... A45F 5/10 229/117.13
2,248,234 A * 7/1941 Hickman ..... A47J 45/10 294/137
2,298,191 A 10/1942 Boh
2,301,216 A * 11/1942 Koontz ..... A47G 23/0241 248/346.03
2,513,762 A * 7/1950 Tyson, Jr. ..... A47G 23/065 294/159
2,600,429 A * 6/1952 Ranseen ..... G09F 1/06 248/451
2,841,435 A * 7/1958 Rochon ..... B65D 71/50 294/87.28
2,845,733 A * 8/1958 Fox ..... A47G 1/141 248/459
2,936,070 A * 5/1960 Poupitch ..... B65D 71/504 206/150
2,979,192 A 4/1961 Blonder
3,050,183 A * 8/1962 Mueller, Jr. ..... B65D 73/0085 206/446
3,085,683 A * 4/1963 Harrison ..... B65D 71/44 206/158
3,137,109 A * 6/1964 Rapata ..... B65D 71/50 53/398
3,200,944 A * 8/1965 Rapata ..... B65D 71/50 206/158
3,297,289 A * 1/1967 La Raus ..... A47G 7/06 206/423
3,317,234 A * 5/1967 Burford ..... B65D 71/50 206/145
3,355,830 A * 12/1967 Hoffman ..... B65D 71/44 40/310
3,365,761 A * 1/1968 Kalvig ..... B25H 3/04 211/65
3,443,685 A * 5/1969 Wanderer ..... B65D 71/50 206/150
3,601,253 A * 8/1971 Poupitch ..... B65B 17/025 206/153
3,601,439 A * 8/1971 Poupitch ..... B65D 71/50 206/145
3,603,551 A 9/1971 Peterson
3,640,380 A * 2/1972 Huffman ..... A47J 47/14 206/549
3,709,429 A * 1/1973 McKenzie ..... B04B 5/0414 211/74
3,784,002 A * 1/1974 Owen ..... B65D 71/50 206/158
3,831,300 A * 8/1974 Berkhouse ..... G09F 23/00 40/124.09
3,884,354 A 5/1975 Guenther
4,184,595 A * 1/1980 Wackerman ..... B65D 71/0003 206/423
4,281,502 A * 8/1981 Bonkowski ..... B65B 17/025 53/133.8
4,362,239 A 12/1982 Roccaforte
4,589,552 A * 5/1986 Chevalier ..... B65D 75/14 206/424
4,706,804 A 11/1987 Hall
5,267,644 A 12/1993 Tsao
5,289,650 A * 3/1994 Follett ..... G09F 3/04 206/499
5,320,216 A * 6/1994 Pangborn ..... B65D 71/48 206/148
5,344,006 A 9/1994 Mazzeo
5,348,156 A * 9/1994 Maroszek ..... B65D 5/0254 206/216
D354,679 S * 1/1995 Dunn ..... D9/415
5,390,435 A * 2/1995 Grody ..... G09F 23/06 40/310
5,390,794 A 2/1995 Vulpitta
5,485,914 A * 1/1996 Martin ..... B65D 71/406 206/145
5,493,801 A 2/1996 James
5,551,566 A * 9/1996 Sutherland ..... B65D 71/40 206/150
5,667,070 A 9/1997 Miret
5,695,232 A * 12/1997 Tipp ..... A45F 5/10 206/150
5,706,936 A * 1/1998 Bernstein ..... B65D 71/44 206/145
5,711,419 A * 1/1998 Beales ..... B65D 71/40 206/147
5,735,394 A 4/1998 Harrelson

(56) References Cited

U.S. PATENT DOCUMENTS 5,743,389 A * 4/1998 Cutler ..... B65D 71/0003 206/194
5,791,464 A * 8/1998 Galbierz ..... B65D 71/40 206/145
5,820,185 A * 10/1998 Gomes ..... B65D 71/48 294/87.2
5,826,356 A * 10/1998 Lapp ..... B65D 5/4233 40/310
5,845,776 A * 12/1998 Galbierz ..... B65D 71/48 206/427
5,961,043 A * 10/1999 Samuelson ..... A01M 1/2044 239/54
6,015,043 A * 1/2000 Sandberg ..... B65D 5/5009 206/446
D420,575 S * 2/2000 Rovere ..... D9/752
6,059,099 A * 5/2000 Galbierz ..... B65D 71/42 206/151
6,073,758 A 6/2000 Webster
6,168,012 B1 * 1/2001 Galbierz ..... B65D 71/46 206/151
6,293,392 B1 * 9/2001 Galbierz ..... B65D 71/40 206/148
6,298,992 B1 * 10/2001 Tsao ..... B65D 71/48 206/194
6,385,874 B1 * 5/2002 Tsonas ..... G09F 1/04 40/124.09
6,793,071 B2 * 9/2004 Rhyne ..... B65D 71/46 206/223
6,994,246 B2 2/2006 Ichikawa
7,143,892 B2 12/2006 Kolton
7,281,345 B2 10/2007 Ludlow et al.
7,537,193 B2 * 5/2009 Dempsey ..... A47F 5/112 206/45.24
7,836,622 B1 11/2010 King
8,083,126 B2 12/2011 Fleming
8,087,511 B2 * 1/2012 Libit ..... B65D 71/0074 206/162
8,091,702 B1 * 1/2012 Keip ..... A47G 23/0208 206/171
8,096,413 B2 * 1/2012 Coltri De Paula .... B65D 71/42 206/153
8,522,966 B1 * 9/2013 Siebel ..... B65D 71/48 206/141
9,248,210 B2 * 2/2016 Kunesh ..... A61L 9/12
9,635,959 B1 * 5/2017 Ali ..... B65D 73/0064
9,676,536 B2 * 6/2017 Milbrandt ..... B65D 23/005
9,930,975 B2 * 4/2018 Rohrig ..... B65D 73/0085
9,932,160 B2 * 4/2018 Smith ..... B65D 71/48
9,981,777 B1 * 5/2018 Thomson ..... B65D 23/14
2003/0006150 A1 * 1/2003 Saulas ..... B65D 71/46 206/153
2003/0192788 A1 10/2003 Marco
2005/0166439 A1 8/2005 Ludlow
2005/0211578 A1 * 9/2005 Libit ..... B65D 71/46 206/200
2005/0241964 A1 * 11/2005 Taylor ..... A47G 23/0216 206/170
2006/0091091 A1 5/2006 Tuan Mu
2006/0118432 A1 6/2006 Weaver
2006/0124495 A1 * 6/2006 David ..... B65D 73/0085 206/461
2007/0068896 A1 * 3/2007 Montgomery ..... A61J 9/00 215/397
2007/0251131 A1 * 11/2007 Majerowski ..... A01M 1/2055 40/407
2008/0272011 A1 11/2008 Levy
2008/0283695 A1 * 11/2008 Morgan ..... B65D 73/0092 248/150
2008/0296192 A1 12/2008 Tokie
2009/0152860 A1 6/2009 Bridges
2010/0059578 A1 * 3/2010 Widener ..... B65D 5/18 229/116.1
2012/0153109 A1 6/2012 Milbrandt
2015/0196141 A1 * 7/2015 Rohrig ..... B65D 73/0085 248/318
2015/0375659 A1 * 12/2015 Noble ..... B60N 3/103 229/117.14
2016/0031621 A1 2/2016 Wintz

FOREIGN PATENT DOCUMENTS

DE 4402285 A1 10/1994
FR 2655021 A1 5/1991
JP 2002347841 A 12/2002
WO 96/00687 A1 1/1996
WO 2007084119 A1 7/2007
WO 2011020084 A1 2/2011
WO 2014019005 A1 2/2014
WO 2014036246 A1 3/2014
WO 20140150367 A1 9/2014

OTHER PUBLICATIONS

International Search Report dated Sep. 16, 2015, for corresponding International Application No. PCT/US2015/038822, filed Jul. 1, 2015.
Written Opinion of the International Searching Authority dated Sep. 16, 2015 for corresponding International Application No. PCT/US2015/038822, filed Jul. 1, 2015.
Machine Translation of foreign patent JP-2002347841, Container with Neck Hanging Label, Published Dec. 4, 2002.
Cox, "The elasticity and strength of paper and other fibrous materials," British Journal of Applied Physics, vol. 3, No. 3, http://iopscience.iop.org/0508-3443/3/3/302.
Antoni Amengual Colom, "Analysis of the shape of a sheet of paper when two opposite edges are joined" Mar. 10, 2006, 2006 American Association of Physics Teachers, http://sci-toys.com/bent_paper_problem.pdf.
Extended European Search Report dated Feb. 9, 2018 for European Application No. 17201908.5-1017.
Examination report dated Dec. 5, 2018, in corresponding European application No. EP17201908.5.

* cited by examiner

TAG ASSEMBLY FOR RETAINING AND DISPLAYING PRODUCTS

BACKGROUND

In a product retail environment, products are often displayed for sale while mounted on retention mechanisms such as hooks or rods. Multiple units of a product may be displayed on a single rod, depending upon the length of the rod. A portion of a product or its packaging that engages a retention mechanism such as a rod or hook is typically referred to as a hang tab. Such arrangements are also useful for item storage and/or placement in other environments, in addition to retail display and sale environments. Examples of other suitable environments include high-density item storage, where hanging items from a rod allows for easy and ready retrieval of individual items.

If a product is sold in bottle form, for example, product identification information, product use information, product source information and/or other indicia may be printed on the bottle, on labels attached to the bottle, or on packaging for the bottle. In order to reduce the cost of a product to the consumer, it is desirable to minimize excess packaging if possible.

SUMMARY

In one aspect, a tag assembly comprises a tag panel and a elastomer panel. The tag panel comprises a first panel segment and a second panel segment demarcated from the first panel segment by a first fold line. The second panel segment comprises a panel aperture and a plurality of slits communicating with the panel aperture and defining a plurality of tabs therebetween. A retention aperture is positioned on and through the tag panel. The elastomer panel is bonded to at least the second panel segment and comprises a stretchable aperture, wherein the stretchable aperture overlaps the panel aperture.

In another aspect, a method for displaying a product comprises providing a tag assembly comprising a tag panel and an elastomer panel bonded thereto, wherein the tag panel comprises a panel aperture and a plurality of radially-separated tabs extending around the panel aperture, and wherein the elastomer panel comprises a stretchable aperture that overlaps with the panel aperture. The method further comprises inserting a first portion of the product through the stretchable aperture such that the stretchable aperture stretches from a relaxed state to a stretched state, inserting the first portion of the product through the panel aperture such that the first portion presses the radially-separated tabs of the tag panel in an insertion direction, moving the inserted first portion of the product past the stretchable aperture and the panel aperture such that a second portion of the product having a smaller outer dimension than the first portion moves through the stretchable aperture and the panel aperture, relaxing the stretchable aperture from its stretched state to a partially-relaxed state such that the stretchable aperture conforms to dimensions of the second portion of the product extending therethrough, and restricting the first portion from withdrawing through the panel aperture with the radially-separated tabs of the tag panel.

Moreover, the disclosure, in its various combinations, either in apparatus or method form, may also be characterized by the following listing of items:

1. A tag assembly comprising:
   - a tag panel comprising:
     - a first panel segment;
     - a second panel segment demarcated from the first panel segment by a first fold line, the second panel segment comprising:
       - a panel aperture; and
       - a plurality of slits communicating with the panel aperture and defining a plurality of tabs therebetween; and
     - a retention aperture positioned on and through the tag panel; and
   - an elastomer panel bonded to the second panel segment and comprising a stretchable aperture, wherein the stretchable aperture overlaps the panel aperture.

2. The tag assembly of item 1, wherein the tag panel is inelastic.

3. The tag assembly of any of items 1-2, wherein the panel aperture and the stretchable aperture are substantially concentric.

4. The tag assembly of any of items 1-3, wherein the panel aperture and the stretchable aperture are substantially flush.

5. The tag assembly of any of items 1-4, wherein the panel aperture is in the form of a circle, and wherein the plurality of slits radiate from a center of the circle.

6. The tag assembly of item 5, wherein the second panel segment further comprises a circular line of perforations, slits, or combinations thereof, around the panel aperture, and wherein the circular line intersects the plurality of slits.

7. The tag assembly of any of items 1-6, wherein the elastomer panel is not bonded to a portion of the second panel segment.

8. The tag assembly of any of items 1-7, and further comprising a third panel segment demarcated from the second panel segment by a second fold line.

9. The tag assembly of item 8, and further comprising a fourth panel segment demarcated from the third panel segment by a third fold line.

10. The tag assembly of item 9, the fourth panel segment further comprising an adhesive layer.

11. A method for displaying a product, the method comprising:
   - providing a tag assembly comprising a tag panel and an elastomer panel bonded to the tag panel, wherein the tag panel comprises a panel aperture and a plurality of radially-separated tabs extending around the panel aperture, and wherein the elastomer panel comprises a stretchable aperture that overlaps with the panel aperture;
   - inserting a first portion of the product through the stretchable aperture such that the stretchable aperture stretches from a relaxed state to a stretched state;
   - inserting the first portion of the product through the panel aperture such that the first portion presses the radially-separated tabs of the tag panel in an insertion direction;
   - moving the inserted first portion of the product past the stretchable aperture and the panel aperture such that a second portion of the product having a smaller outer dimension than the first portion moves through the stretchable aperture and the panel aperture;
   - relaxing the stretchable aperture from its stretched state to a partially-relaxed state such that the stretchable aperture conforms to the outer dimension of the second portion of the product extending therethrough; and
   - restricting the first portion from withdrawing through the panel aperture with the radially-separated tabs of the tag panel.

12. The method of item 11, wherein inserting the first portion of the product through the stretchable aperture occurs substantially simultaneously with inserting the first portion of the product through the panel aperture.

13. The method of any of items 11-12, and further comprising folding the tag panel into a tent-like configuration.

14. The method of item 13, and further comprising securing the tag panel in the tent-like configuration using adhesive.

15. The method of any of items 11-14, and further comprising suspending the tag assembly with the inserted product from a retention mechanism.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views. Moreover, analogous structures may be indexed in increments of one hundred. It is contemplated that all descriptions are applicable to like and analogous structures throughout the several embodiments.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

The present disclosure is directed to exemplary embodiments of a tag assembly that is configured to attach to one or more products or other items (e.g., retail and commercial objects) and suspend the retained product(s) from a retention mechanism, such as a display hook. Particularly suitable tag assembly embodiments include areas for carrying product information such as printed indicia. An exemplary tag assembly includes a unique combination of a slit panel aperture and a stretchable elastomeric aperture that overlap each other. In an exemplary embodiment, the slit panel aperture and the stretchable aperture are concentric. This aperture combination allows a product (or multiple products) to be readily inserted into the tag assembly without excessive insertion pressure, while also allowing the inserted product to be securely and reliably retained.

Furthermore, an exemplary embodiment of a tag assembly also includes one or more tag panels that can be folded or otherwise constructed into predefined geometric configurations, such as tent-like configurations. As used herein, the term "tent-like configuration" refers to a geometric configuration that includes a substantially triangular interior region, where the corners of the triangular interior region may be sharp, rounded, or the like; and where the walls of the triangular interior region may be planar or mildly curved. The term "tent-like configuration" also includes a configuration having a peaked top portion and substantially vertical walls. In an exemplary embodiment, a suitable geometric configuration allows the tag assembly to be suspended from a retention mechanism, such as a display hook, in a manner such that the retained product is suspended at or near a center of mass region of the tag assembly. This allows the retained product to be oriented vertically or with a mild tilt, thereby enhancing the aesthetic properties of the display.

Figure 1:
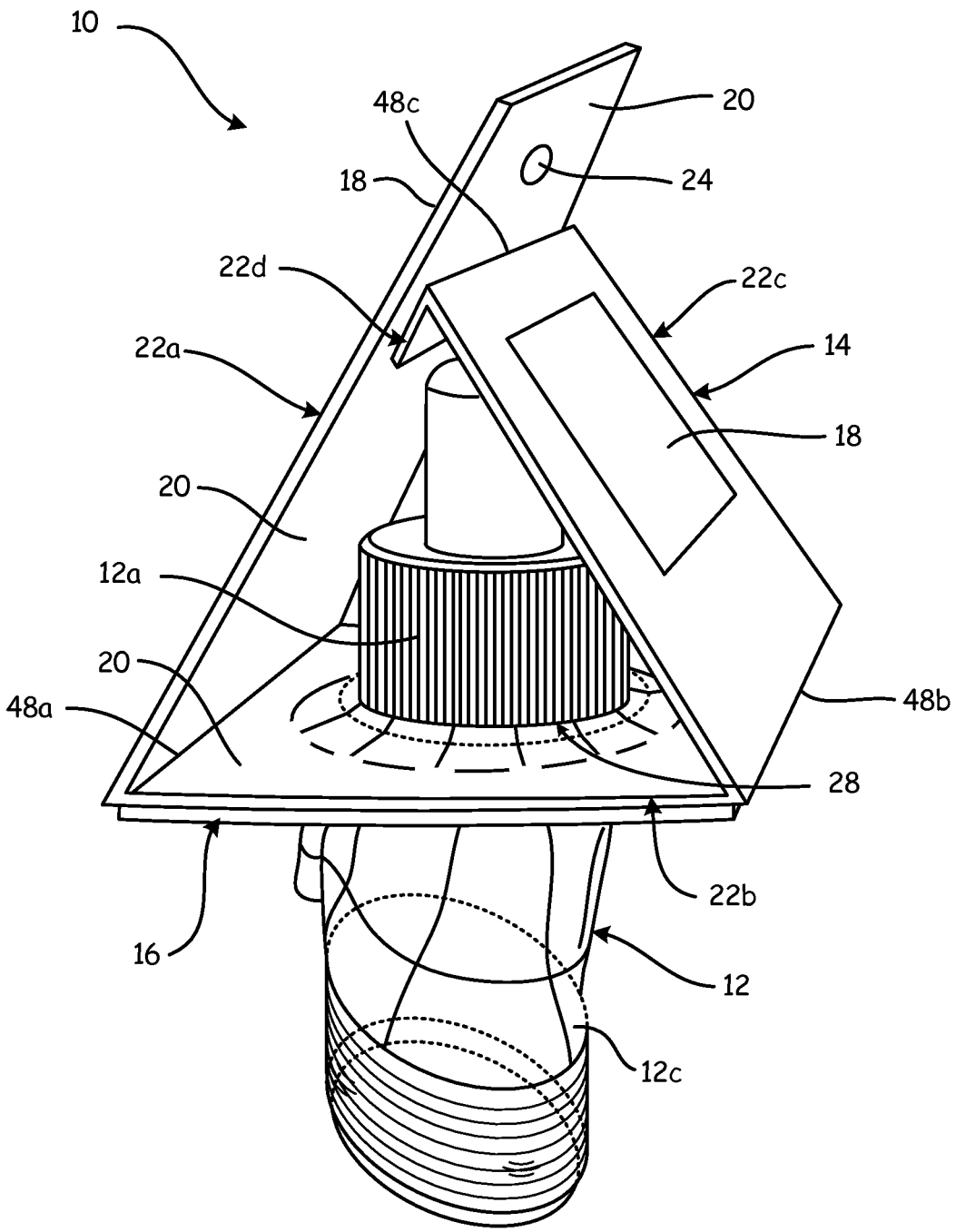
FIG. 1 is a rear and side perspective view of an exemplary embodiment of a tag assembly attached to a product, wherein the tag assembly is folded in a tent-like configuration.

FIGS. 1-7 illustrate a first embodiment of a tag assembly 10, which is shown in use with a product such as bottle 12 (having cap 12*a*, neck 12*b*, and body 12*c*). As shown in FIG. 1, tag assembly 10 includes tag panel 14 and elastomer panel 16. Tag panel 14 includes outer surface 18 and inner surface 20 and is folded into a tent-like configuration with panel segments 22*a*-22*d*. The "outer" and "inner" designations for surfaces 18 and 20 are merely used with reference to the tent-like configuration for ease of discussion and are not intended to otherwise limit the characteristics or orientations of surfaces 18 and 20.

Figure 2:
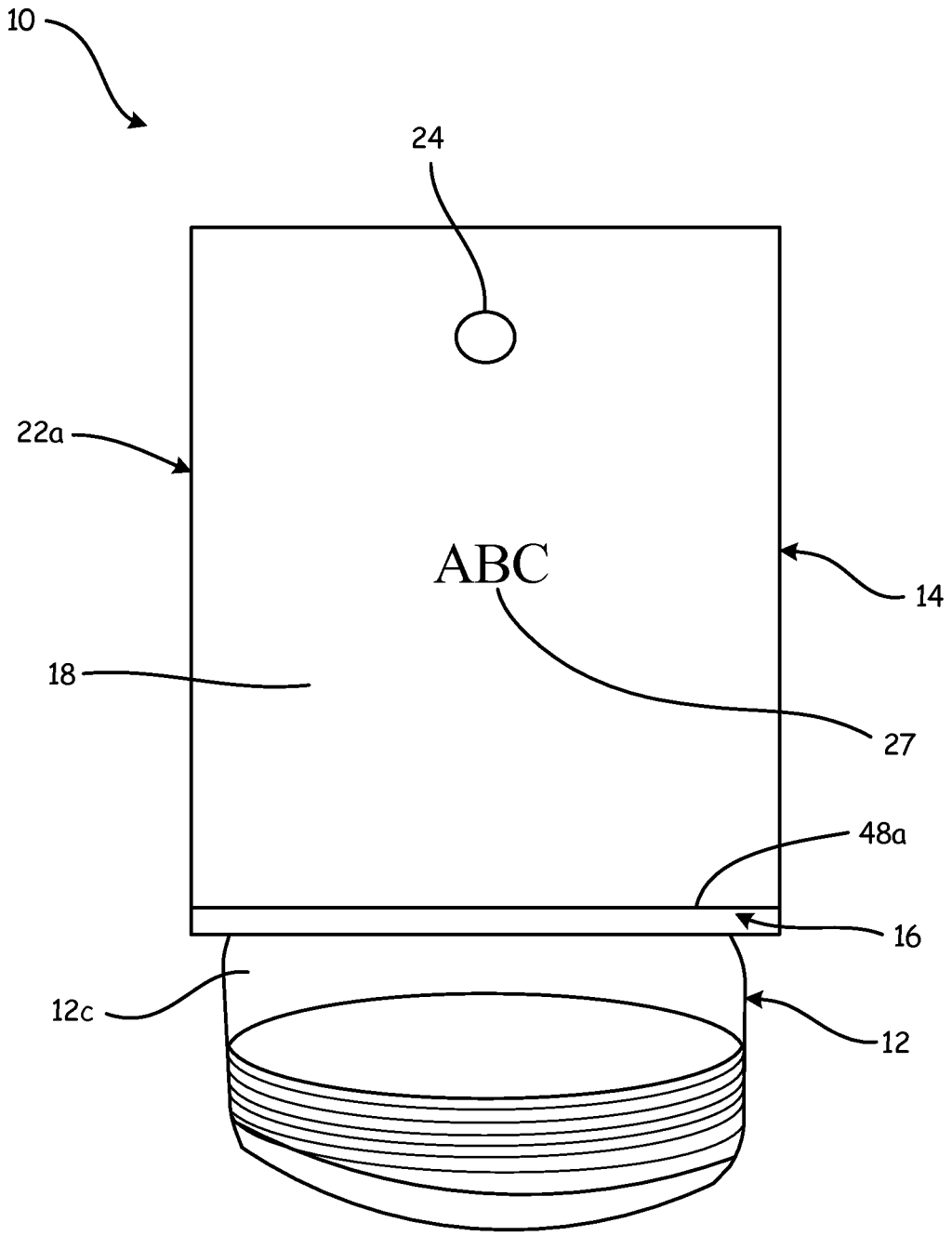
FIG. 2 is a front view of the tag assembly of FIG. 1 with the attached product.

Tag panel 14 includes a retention aperture 24 thereon and therethrough. In an exemplary embodiment, retention aperture 24 is disposed on front panel segment 22*a*. Retention aperture 24 is configured to receive a display hook or other suitable retention mechanism (e.g., display hook 26, shown in FIG. 3) for suspending tag assembly 10 from display hook 26. As best shown in FIG. 2, outer surface 18 provides a convenient and effective location for displaying indicia 27, such as product identifiers, brand identifiers, machine-readable indicia, graphics, other information and the like. Optionally, inner surface 20 may also include indicia.

Bottom panel segment 22*b* includes panel aperture 34 (labeled in FIGS. 4, 6, and 7) for receivably retaining a product, such as bottle 12. Elastomer panel 16 is bonded to outer surface 18 of bottom panel segment 22*b* such that elastomer panel 16 is below bottom panel segment 22*b* when tag assembly 10 is folded and secured in the shown tent-like configuration, and tag assembly 10 is suspended by retention aperture 24 on retention mechanism 26. Elastomer panel 16 includes stretchable aperture 44 (labeled in FIGS. 4, 5 and 7), which in an exemplary embodiment is aligned with panel aperture 34 of bottom panel segment 22*b* of tag panel 14. Together, the aligned panel aperture 34 and stretchable aperture 44 form product aperture 28, through which a portion of product 12 passes for retention of the product 12 in tag assembly 10.

Rear panel segment 22*c* may also include indicia displayed on outer surface 18 (and optionally on inner surface 20). Rear panel segment 22*c* also reinforces the tent-like configuration of tag assembly 10 against the weight of the retained product(s) (e.g., bottle 12).

Figure 3:
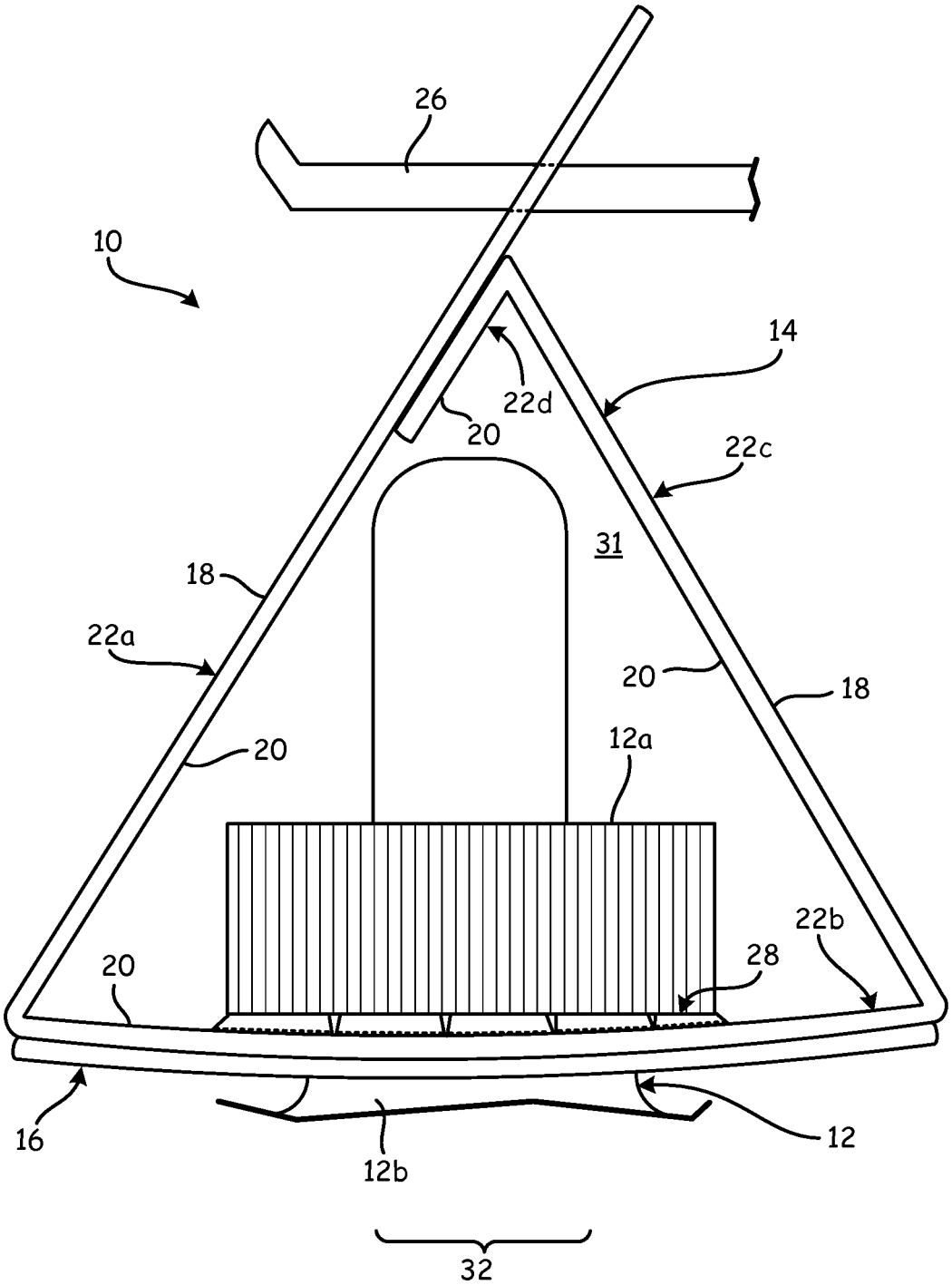
FIG. 3 is a side elevation view of the tag assembly of FIG. 1 with a top portion of the retained product, wherein the tag assembly is suspended from a retention mechanism.
Figure 4:
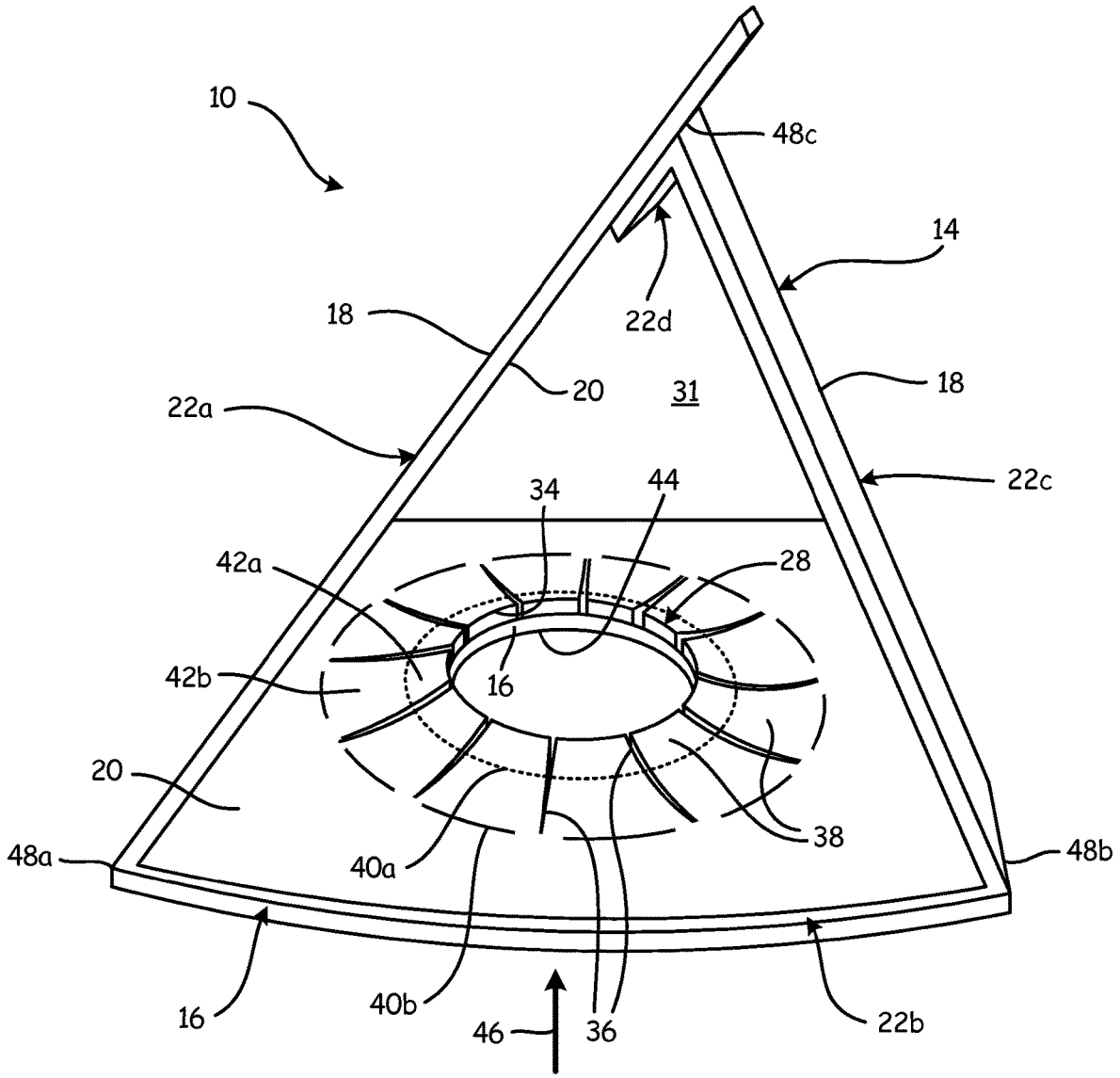
FIG. 4 is a side perspective view of the tag assembly of FIG. 1, removed from the product.

In an exemplary embodiment, flap panel segment 22*d* includes an adhesive layer or film 30 (shown in FIGS. 6 and 7) on outer surface 18 to allow panel segment 22*d* to adhere to inner surface 20 of front panel segment 22*a*, as shown in FIGS. 1, 3 and 4. This securely retains tag assembly 10 in the shown tent-like configuration. Moreover, in an exemplary embodiment, such adhesion positions product aperture 28 at or near the center of mass region 32 of tag assembly 10 when tag assembly 10 is suspended by retention aperture 24 on retention mechanism 26, as shown in FIG. 3. This allows bottle 12 to be oriented vertically or at a mildly-tilted angle when retained by tag assembly 10. In comparison, conventional product display hangers typically retain the associated products in a cantilevered manner, where the tag portions suspended from display hooks are positioned behind the associated products. This can result in severe tilting of the display hangers and the retained products, which can be undesirable for many applications.

Tag panel 14 may be produced from any suitable sheet-based material, such as paper-based and/or polymeric materials, and may be a single-layer or multiple-layer sheet. The material(s) for tag panel 14 are also preferably printable, such that indicia may be printed on outer surface 18 and/or inner surface 20 of one or more of panel segments 22*a*-22*d* using any suitable ink or other printing composition. In an exemplary embodiment, the material for tag panel 14 is also preferably water resistant so as to not degrade or otherwise deform when exposed to water. In an exemplary embodiment, the material for tag panel 14 is also preferably tough enough to be sufficiently tear resistant to prevent damage from customer handling.

In addition, the indicia, particularly any printed visually assessable and/or machine-readable information (e.g., graphics, a bar code, near field communication (NFC) information or a radio frequency identification (RFID) code) can be sufficiently water resistant to avoid degradation when repeatedly subjected to water and washing operations (e.g., as is common for produce displays in supermarkets). Accordingly, tag panel 14 produced from one or more paper-based materials may also include one or more polymeric layers configured to protect and reinforce the paper-based materials, and to protect any indicia. For example, tag panel 14 may include a thin film of water-insoluble, transparent plastic disposed over the indicia to enhance water and wear resistance.

In another embodiment, tag panel 14 is produced from one or more polymeric materials that may receive the printed information and may be opaque, translucent, or transparent. Suitable polymers for tag panel 14 include polystyrenic thermoplastics, polyolefinic thermoplastics (e.g., polyethylene and polypropylene), polyesters, copolymers thereof, blends thereof, and the like. The polymeric material(s) may be formulated so that printing inks are readily accepted on tag panel 14, and/or tag panel 14 may be treated with special surface treatments to enhance acceptance of printing inks. The surface treatment may enhance wettability and adhesion characteristics of tag panel 14 to printing inks. The polymeric material(s) of tag panel 14 also optionally include one or more compatible additives to achieve coloration, opacification, resistance to degradation on exposure to some environments, improved impact properties, improved adhesion properties, and the like.

Additionally, the material(s) for tag panel 14 are preferably inelastic, such that tag panel 14 is substantially non-stretchable. This prevents the printed indicia and graphics on tag panel 14 from being distorted by stretching and also allows panel segments 22*a*-22*d* to retain their tent-like configuration (or any other formed configuration) without stretching, creeping, or otherwise distorting significantly. Furthermore, the material(s) for tag panel 14 are preferably resilient against tensile strains to allow tag panel 14 to carry products (e.g., bottle 12) having substantial weight without tearing or breaking.

In the illustrated example, tag panel 14 is provided as a sheet or film-like member that is long enough to be folded in a tent-like configuration while providing sufficient room in the interior triangular region 31 (labeled in FIGS. 3 and 4) to retain cap 12*a* of bottle 12. Accordingly, the dimensions of tag panel 14 may vary depending on the desired products to be retained. Furthermore, the adhesion location of panel segment 22*d* along inner surface 20 of front panel segment 22*a* may be selected to provide sufficient room in interior triangular region 31 for retaining the product 12 therein, so long as retention aperture 24 is not obstructed. In an exemplary embodiment, an adhesion location of flap panel segment 22*d* on front panel segment 22*a* is also positioned such that retention aperture 24 is located proximate a vertical center of mass region 32 of tag assembly 10.

Tag panel 14 may have any suitable dimensions and shapes, which may vary depending on the particular needs. For example, tag panel 14 may have dimensions and shapes that vary along its length, such as a sinusoidal pattern, widths that vary along the length (e.g., an hourglass shape), individually-tailored designs (e.g., brand logos), and the like. Moreover, panel segments 22*a* and 22*c* may include cut-out holes with individually-tailored designs, if desired, to further provide information and aesthetic characteristics.

Multiple tag panels may also be folded and/or adhered together to produce the desired geometric configuration for a tag assembly, where each tag panel may include any suitable number of foldable and/or attachable panel segments (e.g., panel segments 22*a*-22*d*).

Figure 6:
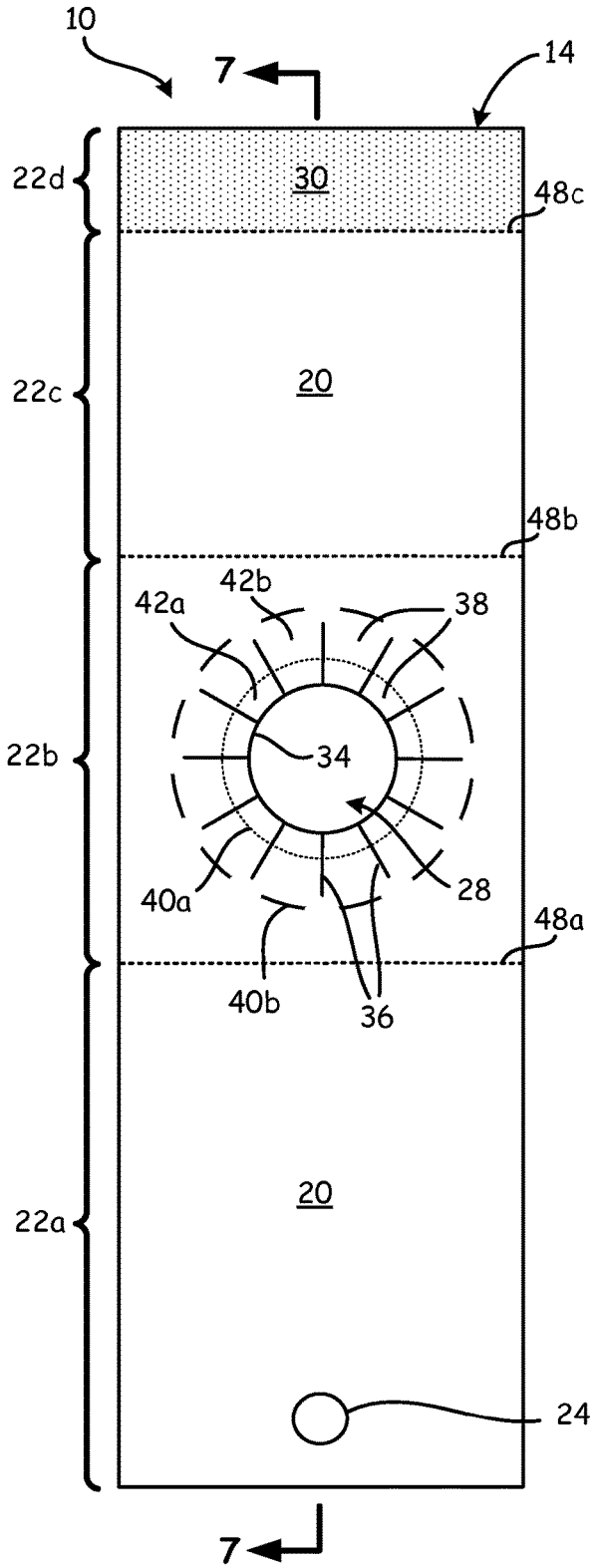
FIG. 6 is top view of an inner surface of the tag assembly of FIG. 1 in an unfolded state.

To form a flat tag assembly 10 of FIG. 6 into the tent configuration of FIG. 1, a user folds tag assembly 10 along fold line 48*a* to demarcate front panel segment 22*a* and bottom panel segment 22*b*; folds tag assembly 10 along fold line 48*b* to demarcate bottom panel segment 22*b* and rear panel segment 22*c*; and folds tag assembly 10 along fold line 48*c* to demarcate rear panel segment 22*c* and flap panel segment 22*d*. If release liner 50 is provided, the user removes release liner 50 from adhesive layer 30. The user adheres adhesive layer 30 to a portion of inner surface 20 of front panel segment 22*a*. In FIG. 1, flap panel segment 22*d* is shown slightly offset from front panel segment 22*a* for ease of seeing the separate parts; however, it is contemplated that in use, the side edges of all the panels 22*a*-22*d* can be aligned.

FIG. 4 further illustrates panel aperture 34 with an exemplary slit configuration. In an exemplary embodiment, panel aperture 34 is in the form of a circle having a center at axis 43 (see FIGS. 6 and 7). A plurality of slits 36 communicate with panel aperture 34 and extend outwardly from the center of the circle (i.e., axis 43) to define a plurality of radially-extending tabs 38 therebetween. In the illustrated embodiment, radial slits 36 intersect with an inner perforation ring or circular line 40*a* and an outer slit-line ring or circular line 40*b*. While inner ring 40*a* is illustrated as being formed with perforations, and outer ring 40*b* is illustrated as being formed with slits, it is contemplated that other structures, or combinations of perforations and slits, for forming lines of weaknesses for inner ring 40*a* and outer ring 40*b* can also be used. Moreover, in some embodiments, inner ring 40*a* and outer ring 40*b* can be omitted, with radial slits 36 being the only cut structures for allowing flexibility in the opening of panel aperture 34.

In the illustrated embodiment, panel aperture 34 and inner ring 40*a* define inner annular region 42*a*; inner ring 40*a* and outer ring 40*b* define outer annular region 42*b*. Radial slits 36 separate tabs 38 in incremental annular portions. In one embodiment, panel aperture 34, inner ring 40*a*, and outer ring 40*b* are concentrically aligned and disposed relative to a central axis 43 (labeled in FIG. 7) extending perpendicular to panel segment 22*b* and radial slits 36 radiate outwardly from central axis 43. Radial slits 36, inner ring 40*a*, and outer ring 40*b* extend through bottom panel segment 22*b* but preferably do not extend through or into elastomer panel 16. This maintains the structural integrity of elastomer panel 16.

Figure 5:
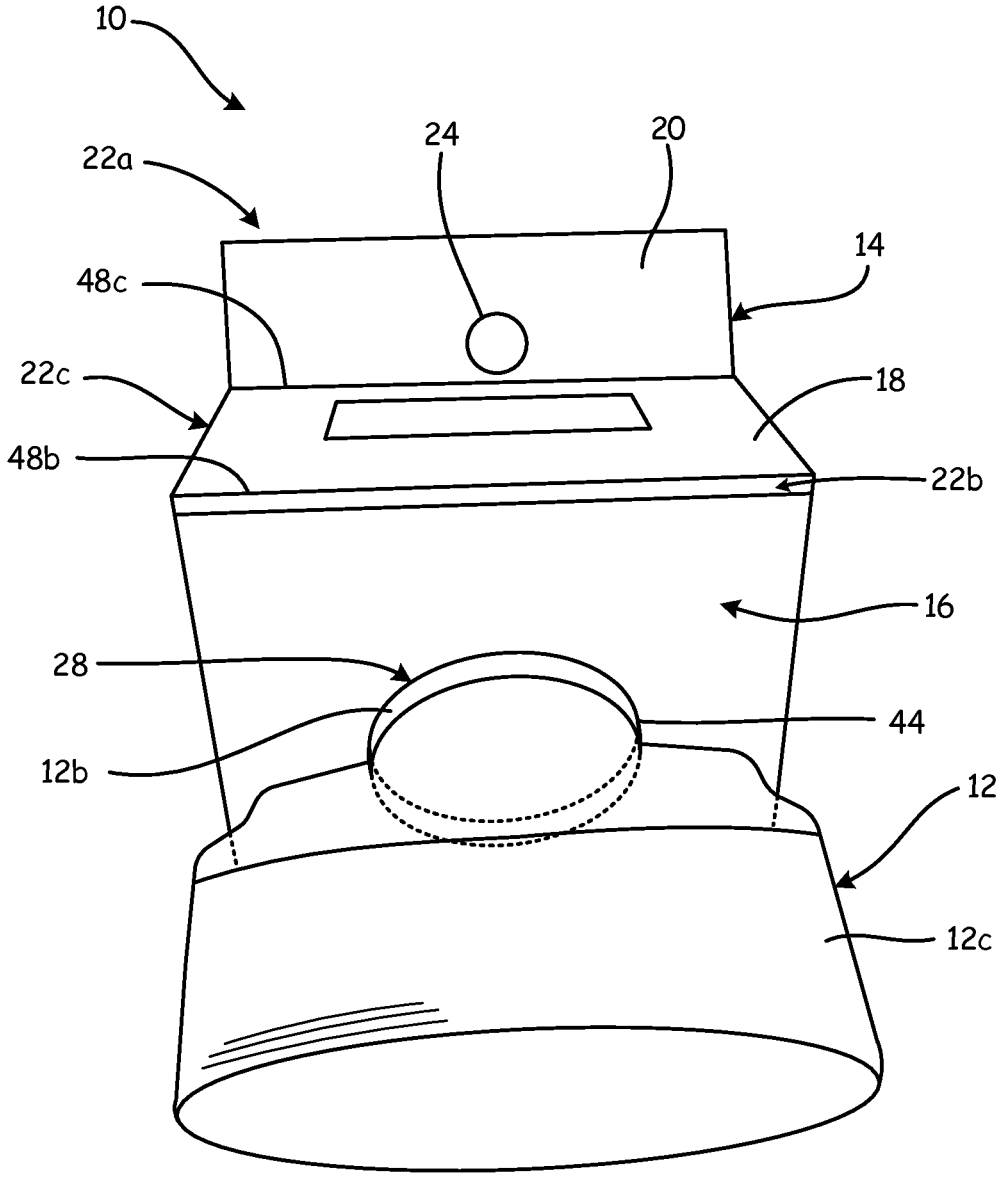
FIG. 5 is a rear bottom perspective view of the tag assembly with the retained product of FIG. 1.
Figure 7:
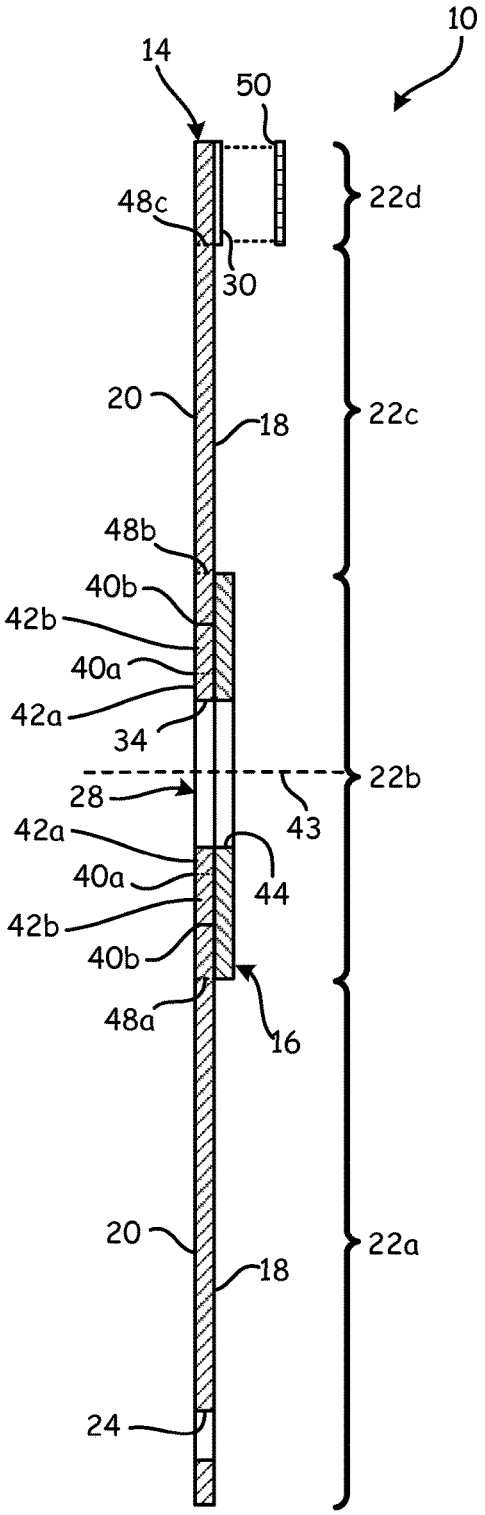
FIG. 7 is a sectional view taken along line 7-7 of FIG. 6.

As further shown in FIGS. 4 and 5, elastomer panel 16 includes stretchable aperture 44. Stretchable aperture 44 overlaps with panel aperture 34. In an exemplary embodiment, stretchable aperture 44 is concentric with panel aperture 34. Moreover, in some embodiments, stretchable aperture 44 has the same dimension as panel aperture 34, and the stretchable aperture 44 and the panel aperture 34 are flush with each other to form a unitary product aperture 28, as shown in FIGS. 6 and 7. However, in comparison to panel aperture 34, stretchable aperture 44 in an exemplary embodiment does not include slits, perforations, scoring, or other cuts corresponding to radial slits 36, inner ring 40*a*, or outer ring 40*b*. Rather, stretchable aperture 44 relies on its elastic characteristics to assist panel aperture 34 in receiving and retaining a product, such as bottle 12, in product aperture 28.

In an exemplary embodiment, elastomer panel 16 is composed of one or more elastomeric materials capable of providing elastic characteristics. Suitable elastomeric materials for elastomer panel 16 include thermoplastic elastomers, such as styrenic block co-polymers (e.g., styrene-butadiene styrene and styrene-ethylene-butylene styrene), olefinic elastomers (e.g., ethylene and polypropylene based polyvinyl chloride-based elastomers, urethanes, nylon, silicon, and the like). The elastomeric materials provide elastomer panel 16 with sufficient elasticity such that stretchable aperture 44 may each be stretched from a relaxed state to a stretched state, and may contract back from its stretched state to its relaxed state (or any partially-retracted state therebetween). Additionally, the elastomeric materials are preferably tactile in a rubber-like manner to reduce slippage of the retained bottle 12.

In an exemplary embodiment, stretchable aperture 44 of elastomer panel 16 and panel aperture 34 of tag panel 14 have substantially the same diameter (or other cross-sectional dimensions). In such an embodiment, stretchable aperture 44 and panel aperture 34 are substantially flush (i.e., coextensive) with each other when they are concentric, forming product aperture 28 with overlapped stretchable and slit apertures. Such a diameter of panel aperture 34 is based on tabs 38 being planar with the remainder of panel segment 22*b* rather than extending upward as shown in FIGS. 1, 3, and 4 after receiving an inserted product. Correspondingly, the described diameter of stretchable aperture 44 in its relaxed (non-stretched) state.

In alternative embodiments, the diameter of stretchable aperture 44 may be different from the diameter of panel aperture 34, depending on the desired insertion and retention forces. Furthermore, while panel aperture 34 and stretchable aperture 44 are illustrated as having substantially circular configurations, in alternative embodiments, one or both of panel aperture 34 and stretchable aperture 44 may have any suitable geometry (e.g., a square-shaped geometry or an artistically-shaped configuration).

In any case, in an exemplary embodiment, the inner diameters of panel aperture 34 and stretchable aperture 44 are smaller than a dimension of at least a portion of the inserted product 12 to be retained by tag assembly 10. For instance, during use, cap 12*a* of bottle 12 may be inserted through product aperture 28, consisting of stretchable aperture 44 and panel aperture 34, in insertion direction 46, shown in FIG. 4. Because stretchable aperture 44 is directly under panel aperture 34, insertion of cap 12*a* through both stretchable aperture 44 and panel aperture 34 occurs substantially simultaneously. In an exemplary embodiment, cap 12*a* has an outer diameter that is greater than the diameter of stretchable aperture 44, and the insertion pressure stretches the elastomeric material of stretchable aperture 44 from its relaxed state to a stretched state. The required insertion pressure is dependent on the durometer and thickness of the elastomeric material and the relative sizes of stretchable aperture 44 and the inserted portion of product 12. In an exemplary method of insertion, cap 12*a* passes substantially concurrently through panel aperture 34 of tag panel 14. Tabs 38 spread along radial slits 36 to facilitate passage of cap 12*a* therethrough and upward in the insertion direction 46. Tabs 38 are accordingly also pressed upward in insertion direction 46. Depending on the outer diameter of cap 12*a*, tabs 38 may only extend upward within the inner annular region 42*a*, and the portions of tabs 38 at the outer annular region 42*b* may remain substantially planar with the remainder of panel portion 22*b*. This reduces the annular zone surrounding panel aperture 34 that is pressed upwards, thereby effectively preserving the size of panel aperture 34. In product aperture 28, both stretchable aperture 44 and panel aperture 34 cooperate to retain product 12 in tag assembly 10. Accordingly, the required insertion pressure may be relatively low compared to the retention strength. This ease of insertion can further assist in automating an insertion process.

When cap 12*a* is fully inserted past product aperture 28, neck 12*b* is then positioned through stretchable aperture 44 and panel aperture 34. Typically, neck 12*b* has a smaller outer diameter compared to cap 12*a*. Thus, the elastomeric material of stretchable aperture 44 contracts at least partially back to its relaxed state to conform to the dimensions of neck 12*b*. This frictionally retains neck 12*b* in stretchable aperture 44 due to the tactile characteristics of the elastomeric material and the elastic bias of stretchable aperture 44.

In an exemplary embodiment, bottom panel segment 22*b* is bonded to elastomer panel 16 outside of outer annular region 42*b*. Thus, between the panel aperture 34 and the outer ring 40*b*, tabs 38 of tab panel 14 may move upward and downward independently of elastomer panel 16. The stiffness of the material of tab panel 14 biases tabs 38 a relatively planar orientation with respect to bottom panel segment 22*b*. Thus, after cap 12*a* of larger dimension has passed through panel aperture 34, tabs 38 collapse inward (toward center axis 43) against neck 12*b*. In an exemplary embodiment, the diameter of panel aperture 34 is smaller than the outer diameter of neck 12*b*; thus, tabs 38 still incline upward (e.g., as illustrated in FIGS. 1, 3 and 4). Thus, the upwardly-extending tabs 38 at panel aperture 34 can catch beneath the larger diameter of cap 12*a*, thereby restricting cap 12*a* from being withdrawn downward through panel aperture 34. This effectively locks cap 12*a* in tag assembly 10.

This unique structure of product aperture 28 allows products (e.g., bottle 12) to be inserted with low insertion pressures, while also achieving secure and reliable retention of the product 12 to prevent it from slipping or other detachment from tag assembly 10. Moreover, the relatively high removal pressure level required to overcome the combined retentions of stretchable aperture 44 and panel aperture 34 can assist in tamper and theft prevention of the retained product(s) 12.

While elastomer panel 16 is illustrated as being bonded only to bottom panel segment 22*b* in alternative embodiments, elastomer panel 16 may also extend partially or fully across one or both of panel segments 22*a* and 22*c*, as desired. In further alternative embodiments, elastomer panel 16 may only partially cover outer surface 18 of bottom panel segment 22*b* such that a sufficient amount of the elastomer material is present to maintain a sufficient bond between elastomer panel 16 and bottom panel segment 22*b*.

In one embodiment, bottom panel segment 22*b* is not bonded to the elastomeric material of elastomer panel 16 at inner annular region 42*a* but is otherwise bonded to elastomer panel 16 at a remainder of panel segment 22*b* (including, in an embodiment, at outer annular region 42*b*). Elastomer panel 16 may be coated with a release agent (e.g., a silicone release agent coating) to prevent the elastomeric material from bonding to tabs 38 at inner annular region 42*a*. As discussed above, this allows tabs 38 at inner annular region 42*a* to be readily pressed upwards by an inserted product, but also allows tabs 38 to pulled back inward (under the bias of the elastomeric material at outer annular region 42*b*) to a partially collapsed state.

In an alternative embodiment, tabs 38 are not bonded to the elastomeric material of elastomer panel 16 at inner annular region 42*a* or outer annular region 42*b* but are otherwise bonded to elastomer panel 16 on a remainder of bottom panel segment 22*b*. In this embodiment, elastomer panel 16 may be coated with a release agent (e.g., a silicone release agent coating) on an area of elastomer panel 16 between stretchable aperture 44 and a portion contacting outer ring 40*b* of tag panel 14.

In a further alternative embodiment, tabs 38 are bonded to the elastomeric material of elastomer panel 16 at inner annular region 42*a* and outer annular region 42*b* (moreover, elastomer panel 16 is bonded to the remainder of panel segment 22*b*). In this embodiment, the separation of tabs 38 at radial slits 36 also stretches the bonded portions of the elastomeric material. This can increase the insertion pressure required to insert a product (e.g., bottle 12) into product aperture 28, since the separation of tabs 38 is required to also overcome the elastic bias of the elastomeric material. However, the bonded elastomeric material may assist in holding tabs 38 together and for partially collapsing tabs 38 back inward.

In a variation of this alternative embodiment, the bond between the elastomeric material of elastomer panel 16 at inner annular region 42*a* may be breached by an applied insertion pressure, such that tabs 38 at inner annular region 42*a* can delaminate from the elastomeric material of elastomer panel 16 when being pressed upwards. This embodiment may assist in holding tabs 38 together prior to use with an inserted product, which can prevent tabs 38 from prematurely bending.

Figure 16:
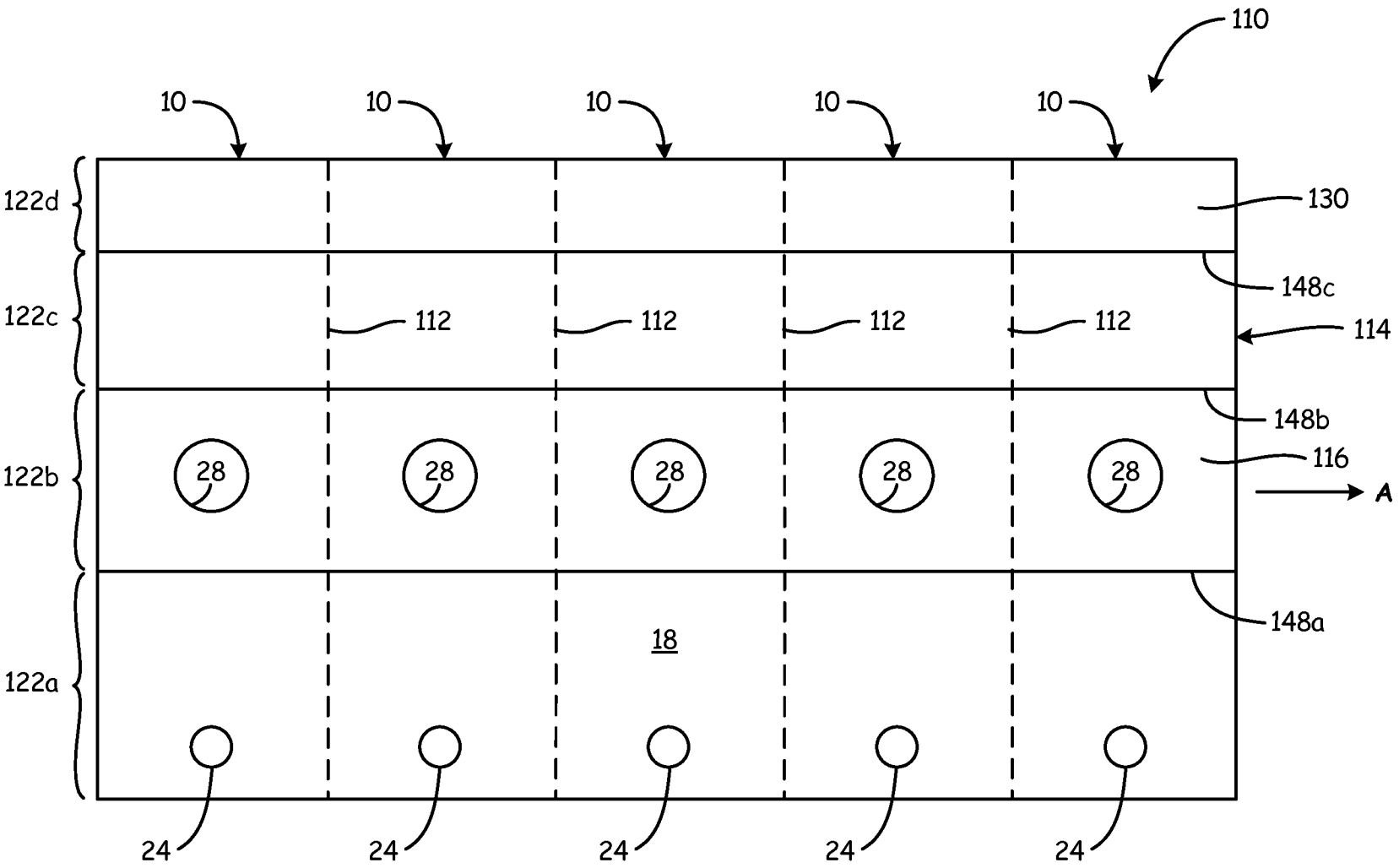
FIG. 16 is an outer surface plan view of an exemplary web of multiple tag assemblies.

FIGS. 6 and 7 illustrate tag assembly 10 prior to being folded in a tent-like configuration. Tag assembly 10 may be manufactured using a web-based continuous process, where multiple tag assemblies 10 may be produced together in sheet form, as shown in FIG. 16. FIG. 16 is an outer surface plan view of an exemplary web 110 of multiple tag assemblies 10. FIG. 16 illustrates web outer surface 18 of 110, which is a manufactured sheet that includes multiple tag assemblies 10. Tag assemblies 10 may be manufactured using a variety of different techniques. Examples of suitable techniques for manufacturing tag assembly 10 include those disclosed in Ludlow et al., U.S. Pat. No. 7,281,345 and Ludlow et al., International Application Publication No. WO07/084119. For example, as shown in FIG. 16, a web of multiple assemblies 110 (i.e., a sheet 110) may be manufactured using a continuous web-based process, where adjacent assemblies 10 may be separable with score or perforation lines 112.

In the illustrated embodiment, a sheet of tag material 114 for the tag panels 14 may advance in the direction of arrow A, and may be aligned with an advancing strip 116 of elastic material for the elastomer panels 16. In the illustrated embodiment, strip 116 of elastic material is sized to cover the strip 122*b* of the plurality of bottom panel segments 22*b*. Strip 116 of elastic material is bonded together with sheet 114 of tag material at all or some of the overlapping areas around product aperture 28 (as discussed above). Strip 116 of elastic material and sheet 114 of tag material may be bonded together using a variety of different bonding techniques, such as thermal bonding, adhesive bonding, ultrasonic bonding, and the like. Examples of suitable bonding techniques are disclosed in Maltas et al., U.S. Pat. No. 7,763,135.

In some embodiments, sheet 114 of tag material may have indicia or other information already applied prior to the bonding step. Alternatively, after the strip 116 of elastic material and sheet 114 of tab material are bonded together, indicia or other information may be printed to one or more of the strip 116 or sheet 114.

Retention apertures 24, panel apertures 34, radial slits 36, inner perforation rings 40*a* and outer slit-line rings 40*b* (some features not visible under elastic strip 116 of FIG. 16)

may be cut in sheet 114 prior to bonding elastic strip 116 thereto. Such cutting may be accomplished by using any suitable mechanism, such as die cutting, laser cutting, and the like. Where panel apertures 34 of sheet 114 and stretchable apertures 44 of elastic strip 116 have the same dimensions, they can be cut into web 110 simultaneously. Score or perforation lines 112 may be cut or otherwise formed in the advancing web 110 to define the separable assemblies 10. Likewise, other shaping or processing of the web 110 may be accomplished. The plurality of retention apertures 24, panel apertures 34, radial slits 36, inner perforation rings 40*a* and outer slit-line rings 40*b*, and perforation lines 112 are spaced apart in direction A, so that they are appropriately positioned on the respective plurality of tag assemblies 10.

In an exemplary embodiment, sheet of tag material 114 and strip 116 of elastic material are desirably joined so that the sheet character of web 110 is maintained. In particular, sheet of tag material 114, strip of elastic material 116, and adhesive layer 130 may be coextruded and/or co-laminated using a web-based process. After the manufacturing process is complete, the individual tag assemblies 10 may be separated along a line of weakness (e.g., perforation line 112) for individual use, maintained in the sheet form of web 110, or rolled onto a spool, for example, for compact storage, transport and use. Provision of web 110 in rolled form could facilitate automated application of tag assemblies 10 from the roll to products 12.

As further shown, web 110 may also include fold line 148*a* between strip of front panel segments 122*a* and strip of bottom panel segments 122*b*; fold line 148*b* between strip of bottom panel segments 122*b* and strip of rear panel segments 122*c*; and fold line 148*c* between strip of rear panel segments 122*c* and strip of flap panel segments 122*d*. In an exemplary embodiment, fold lines 148*a-c* are perforated lines cut into sheet 114, or any other suitable demarcation for folding panel segments 22*a*-22*d*. Fold lines 148*a-c* provide a convenient guide for where to fold tag assemblies 10 of web 110 into a predefined geometric configuration, such as the tent-like configuration shown in FIGS. 1-5. Accordingly, web 110 may include any desired number of fold lines at various locations along its length (e.g., along web advancement direction A) to designate how tag panel 14 is to be folded. In an exemplary embodiment, the fold lines define a folded geometric configuration where retention aperture 24 and product aperture 28 are each substantially located within the center of mass region 32 of tag assembly 10, as shown in FIG. 3.

As further shown in FIG. 7, prior to use, adhesive layer 130 may also be covered with an optional release liner 50. A release liner strip is not illustrated in FIG. 16, but it is contemplated that such a release liner strip may be positioned over adhesive strip 130, which covers the outer surface 18 of strip of flap panel segments 122*d*. During use of an individual tag assembly 10, release liner 50 may be removed, and tag panel 14 may be folded (manually or in an automated process) into the tent-like configuration shown in FIGS. 1-5. When properly positioned, the exposed adhesive layer 30 may be pressed against inner surface 20 of front panel segment 22*a* to secure flap panel segment 22*d* to front panel segment 22*a*. This maintains the structural integrity of the tent-like configuration.

Alternative embodiments of tag assembly 10 are presented below. The features of each alternative assembly may be interchangeable with any of the assemblies discussed herein, so long as their intended functions are not compromised. Furthermore, each of the below-discussed assemblies may be manufactured using similar processes to that discussed above for web 110 of FIG. 16.

Figure 8:
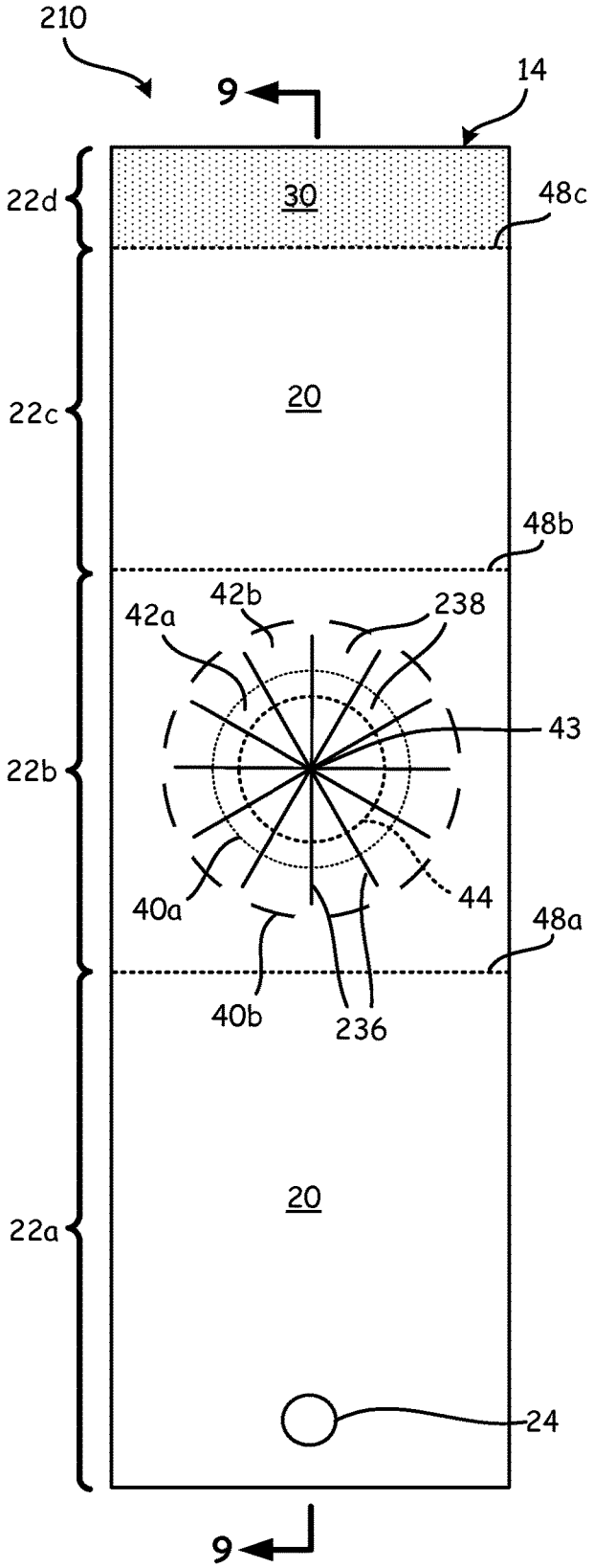
FIG. 8 is top view of an inner surface of another exemplary embodiment of a tag assembly in an unfolded state, which includes a panel aperture that is fully closed with radially-separated tabs.
Figure 9:
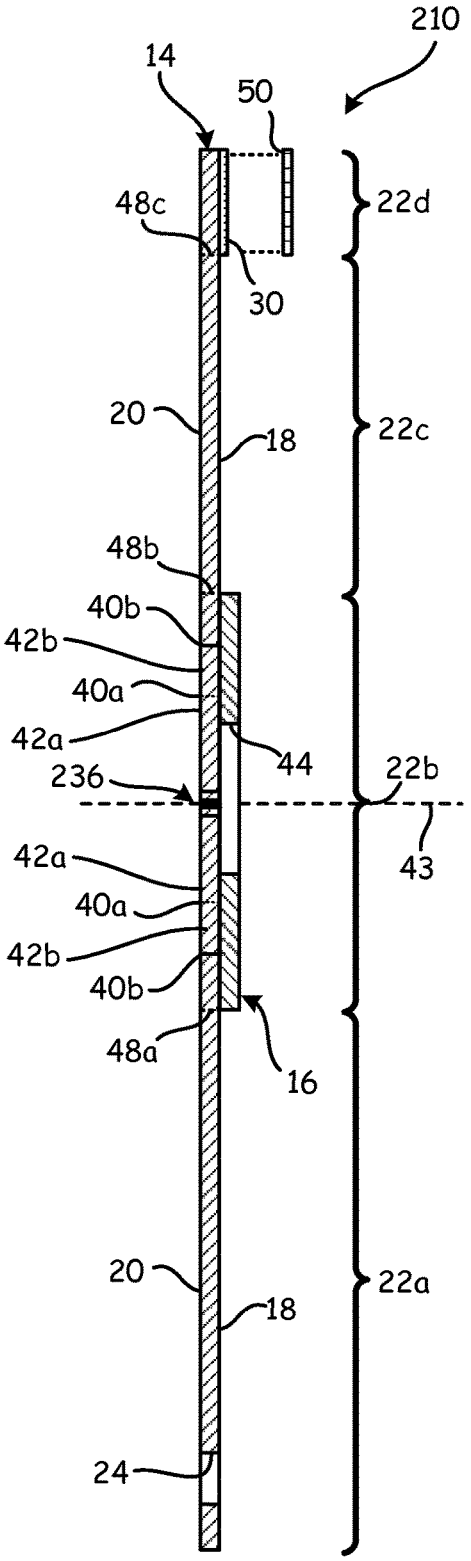
FIG. 9 is a sectional view taken along line 9-9 of FIG. 8.

FIGS. 8 and 9 illustrate an alternative embodiment for a tag assembly, labeled tag assembly 210, wherein the panel aperture 34 at center 43 is initially closed, and radial slits 36 and tabs 38 extend inward to meet at central axis 43. As such, tabs 238 in this embodiment are longer than tabs 38 discussed above for the embodiment shown in FIGS. 1-7, but may otherwise function similarly by extending upward for locking an inserted product 12 in the tag assembly 10, 210. This embodiment is particularly suitable for use with products having longer and/or narrower necks and illustrates how tag assembly 10, 210 may be designed for use with products having different geometries.

Figure 10:
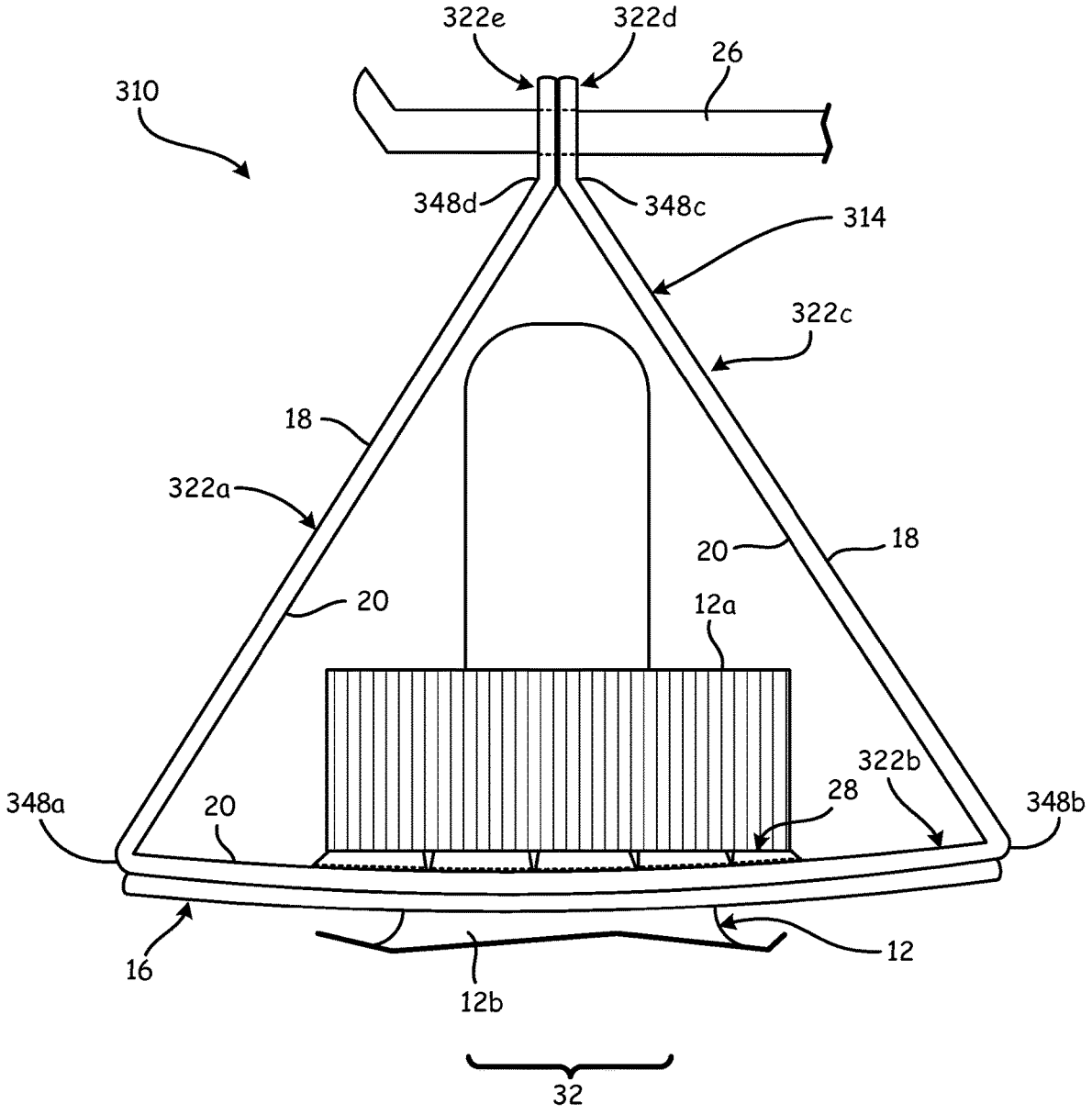
FIG. 10 is a side schematic view of another exemplary embodiment of a tag assembly with a top portion of an attached product. In this embodiment, the tag assembly has a pair of upward-extending panel segments for suspension from a retention mechanism.
Figure 11:
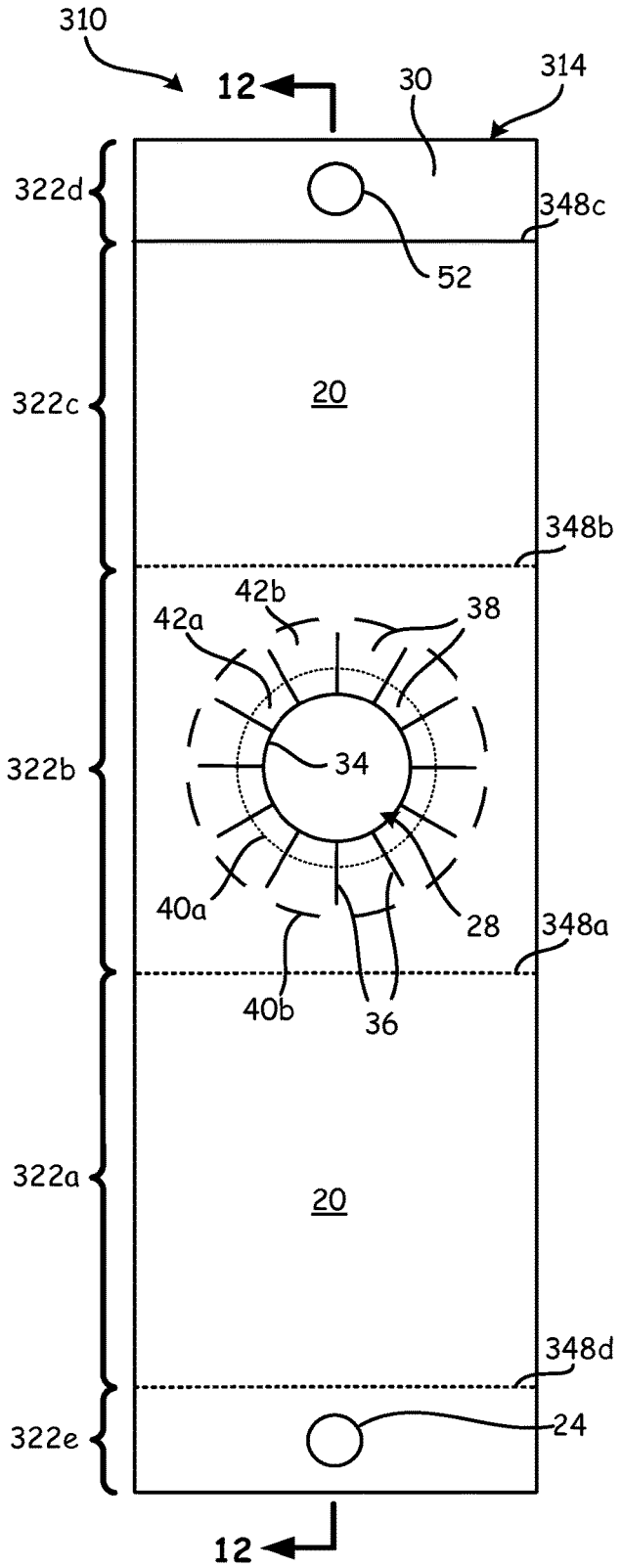
FIG. 11 is top view of an inner surface of the tag assembly shown in FIG. 10 in an unfolded state.
Figure 12:
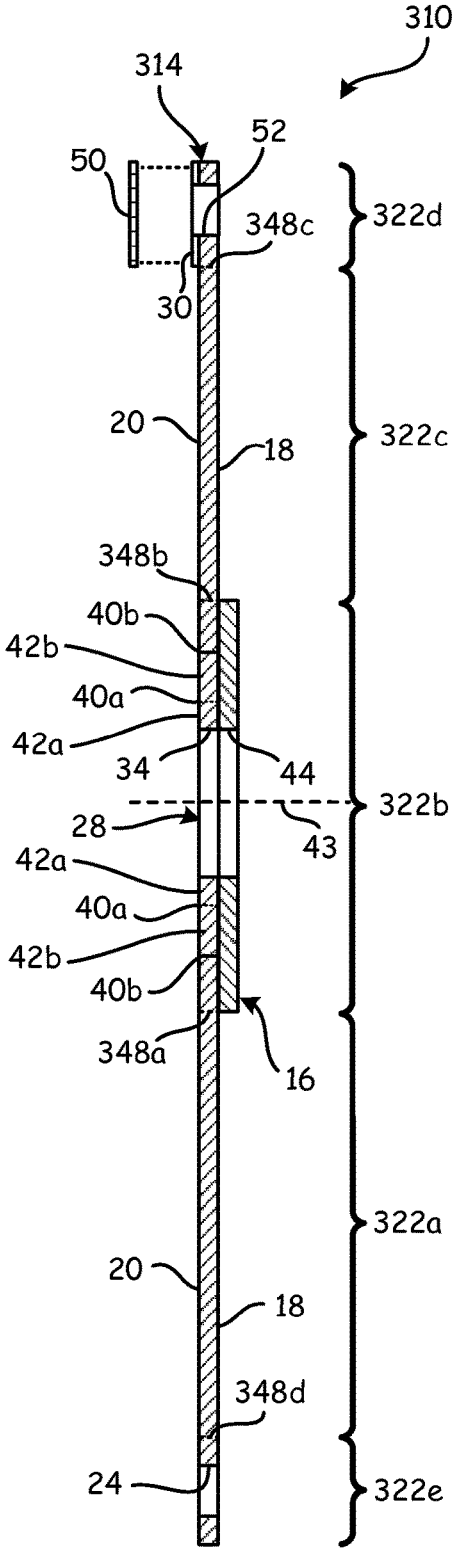
FIG. 12 is a sectional view taken along line 12-12 of FIG. 11.

FIGS. 10-12 illustrate another alternative embodiment of a tag assembly 310, where tag panel 314 includes front panel segment 322*a*, bottom panel segment 322*b* rear panel segment 322*c*, rear flap panel segment 322*d*, and front flap panel segment 322*e*. Front flap panel segment 322*e* extends from front panel segment 322*a* at fold line 348*d*. Rear flap panel segment 322*d* extends from rear panel segment 322*c* at fold line 348*c*.

To form a flat tag assembly 310 of FIG. 11 into the tent configuration of FIG. 10, a user folds tag assembly 310 along fold line 348*a* to demarcate front panel segment 322*a* and bottom panel segment 322*b*; folds tag assembly 310 along fold line 348*b* to demarcate bottom panel segment 322*b* and rear panel segment 322*c*; folds tag assembly 310 along fold line 348*c* to demarcate rear panel segment 322*c* and rear flap panel segment 322*d*; and folds tag assembly 310 along fold line 348*d* to demarcate front panel segment 322*a* and front flap panel segment 322*e*. If release liner 50 is provided, the user removes release liner 50 from adhesive layer 30. The user adheres adhesive layer 30 on inner surface 20 of rear flap panel segment 322*d* to inner surface 20 of front flap panel segment 322*e*. In another embodiment, adhesive layer 30 is also or alternatively located on inner surface 20 front flap panel segment 322*e*. In the illustrated embodiment, rear flap panel segment 322*d* includes retention aperture 52, which is aligned with retention aperture 24 when flap panel segments 322*d* and 322*e* are adhered together. As best shown in FIG. 10, this arrangement also allows bottle 12 to be oriented vertically or at a mildly-tilted angle when retained by tag assembly 310 and suspended from retention mechanism 26.

Figure 13:
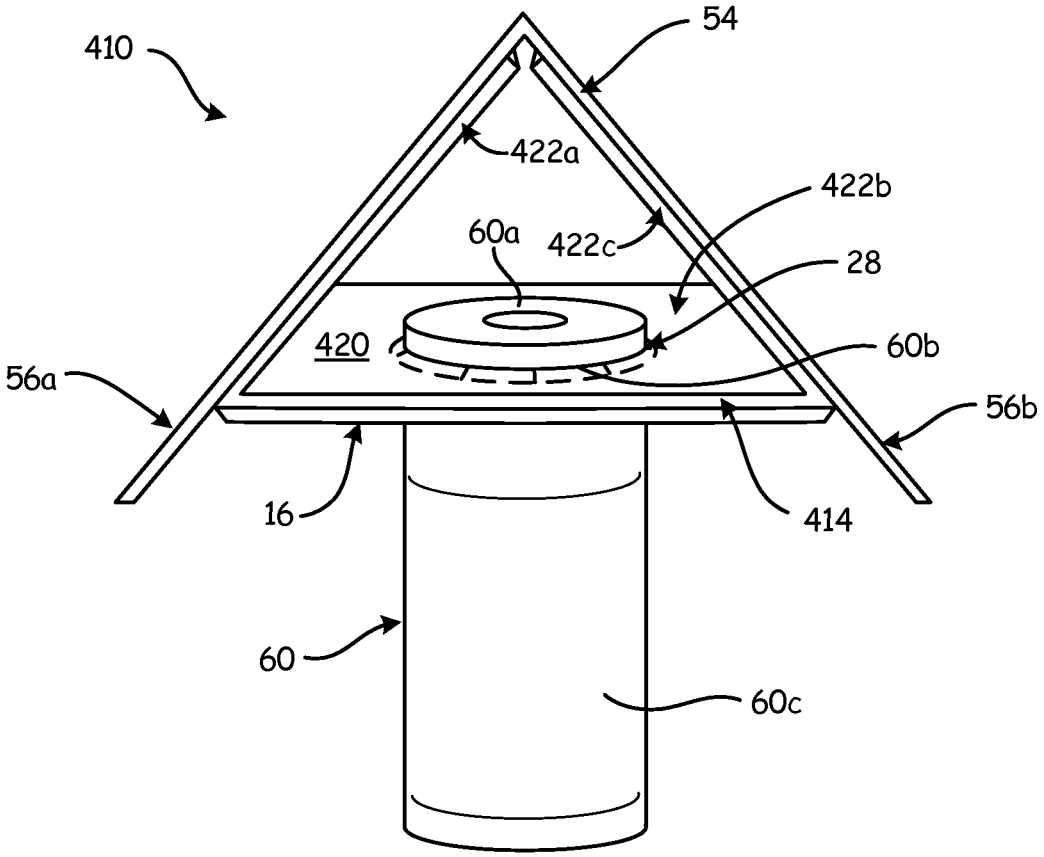
FIG. 13 is a side perspective view of another exemplary embodiment of a tag assembly attached to a rod-shaped item, wherein the tag assembly is constructed into a tent-like configuration with multiple tag panels.
Figure 14:
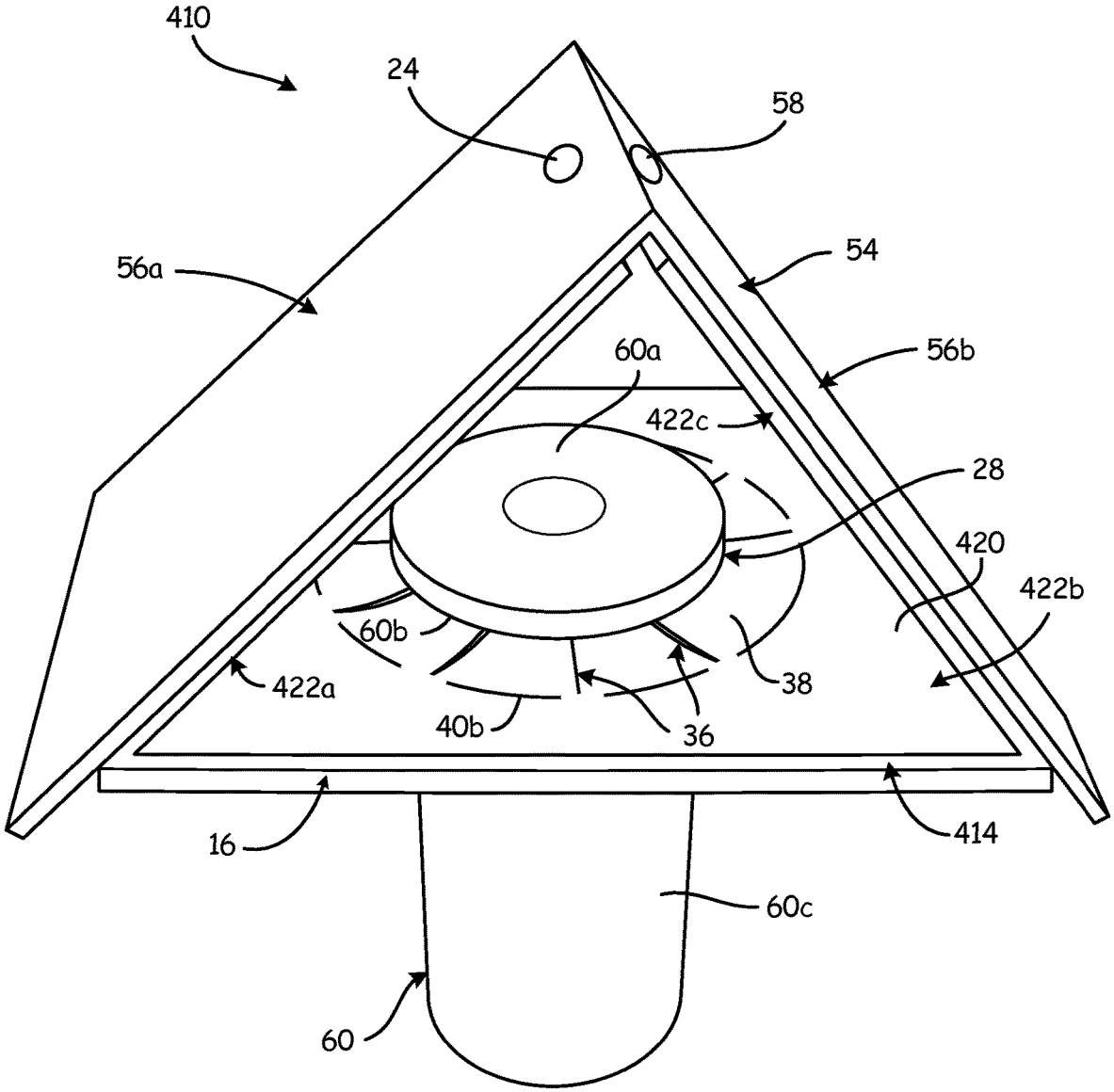
FIG. 14 is a top perspective view of the tag assembly and item of FIG. 13.
Figure 15:
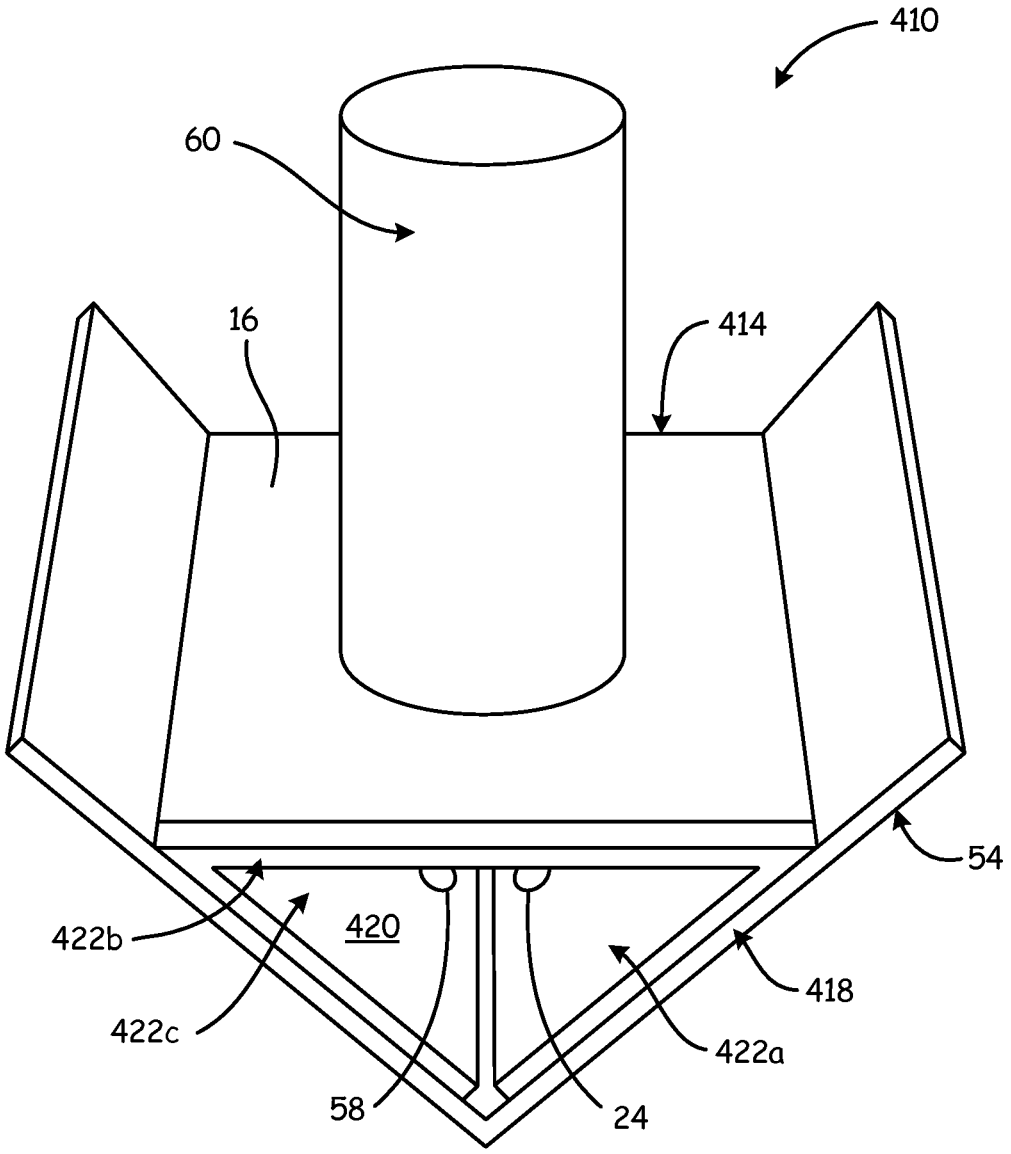
FIG. 15 is a bottom perspective view of the tag assembly and item of FIG. 13.

FIGS. 13-15 illustrate yet another alternative embodiment of tag assembly 410, where a tent-like configuration is constructed from multiple tag panels, including tag panel 414 and tag panel 54. In this embodiment, tag panel 414 is folded into the shown triangular tent-like configuration, and tag panel 54 is folded in half and adhered to outer surface 418 of front panel segment 422*a* and rear panel segment 422*c*, such that tag panel 54 extends downward beyond tag panel 414.

Tag panel 54 includes front panel segment 56*a* and rear panel segment 56*b*, each of which can include indicia. This arrangement allows a generic stock of tag panel 414 to be used with individually-printed tag panels 54, rather than requiring the indicia to be printed or otherwise provided on tag panel 414 itself.

Tag assembly 410 of this embodiment may otherwise function in a similar manner as the above-discussed embodiments, where the retention aperture 24 extends through front segment 56*a* as well as front panel segment 422*a*. Retention aperture 58 extends through rear segment 56*b* as well as rear panel segment 422*c*. Retention aperture 58 is substantially horizontally aligned with retention aperture 24 when tag assembly 410 is in the tent configuration shown in FIGS. 13-15. This allows tag assembly 410 of this embodiment to be suspended from a retention mechanism 26, as discussed above. Additionally, one or more products, such as rod 60 (having head portion 60*a*, a dimensionally-reduced neck portion 60*b*, and body portion 60*c*), may be inserted through product aperture 28 in the same manner as discussed above for securely and reliably retaining rod 60 in tag assembly 410.

The embodiment shown in FIGS. 13-15 further illustrates the use of multiple tag panels 414, 54 for retaining product(s), and suspending the product(s) from retention mechanism(s). As can be appreciated, a tag assembly in accordance with the present disclosure may incorporate one or more tag panels having a variety of different panel segments (e.g., different numbers of panel segments and panel segments with different geometries and sizes) depending on the desired display arrangement. In each embodiment, the combination of combination of panel aperture 34 and stretchable aperture 44 to produce a composite product aperture 28 allows a product (or multiple products) to be readily inserted into the tag assembly without excessive insertion pressure, while also allowing the inserted product to be securely and reliably retained.

Although the present disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A tag assembly comprising:

a tag panel comprising:

a first panel segment including a retention aperture disposed on and through the first panel segment;

a second panel segment demarcated from the first panel segment by a first fold line, the second panel segment comprising:

a panel aperture; and a plurality of slits communicating with the panel aperture defining a plurality of tabs therebetween; and a third panel segment demarcated from the second panel segment by a second fold line, the third panel segment configured to attach to the first panel segment at a selectively variable location between the retention aperture and the first fold line, the third panel segment having no aperture; and an elastomer panel bonded to the second panel segment and comprising a stretchable aperture, wherein the stretchable aperture overlaps the panel aperture.

2. The tag assembly of claim 1, wherein the panel aperture and the stretchable aperture are substantially flush.

3. The tag assembly of claim 1, wherein the panel aperture is in the form of a circle, and wherein the plurality of slits radiate from a center of the circle.

4. The tag assembly of claim 3, wherein the second panel segment comprises a line of weakness around the panel aperture.

5. The tag assembly of claim 4, wherein at least one of the plurality of slits has a length, and wherein the line of weakness is positioned at a distance from the panel aperture that is less than the length so that the line intersects the at least one of the plurality of slits.

6. The tag assembly of claim 1, wherein the elastomer panel is not bonded to a portion of the second panel segment.

7. The tag assembly of claim 1, and further comprising a fourth panel segment demarcated from the third panel segment by a third fold line.

8. The tag assembly of claim 7, the fourth panel segment further comprising an adhesive layer.

9. The tag assembly of claim 1, including an adhesive flap by which the third panel segment is configured to attach to the first panel segment.

10. The tag assembly of claim 1, wherein the panel aperture is in the form of a point, and wherein the plurality of slits radiate from the point.

11. A method for displaying a product, the method comprising:

providing a tag assembly comprising:

a tag panel including:

a first panel segment including a retention aperture disposed on and through the first panel segment;

a second panel segment demarcated from the first panel segment by a first fold line, the second panel segment comprising a plurality of radially separable tabs; and a third panel segment demarcated from the second panel segment by a second fold line; and an elastomer panel bonded to the second panel segment, wherein the elastomer panel comprises a stretchable aperture that overlaps a portion of the plurality of tabs;

inserting a first portion of the product through the stretchable aperture such that the stretchable aperture stretches from a relaxed state to a stretched state;

inserting the first portion of the product through the tag panel such that the first portion presses the tabs of the tag panel in an insertion direction and at least partially separates the plurality of tabs along slits between adjacent tabs of the plurality of tabs;

moving the inserted first portion of the product past the stretchable aperture and the plurality of tabs such that a second portion of the product having a smaller outer dimension than the first portion moves through the stretchable aperture and the tag panel at the plurality of tabs;

relaxing the stretchable aperture from its stretched state to a partially-relaxed state such that the stretchable aperture conforms to the outer dimension of the second portion of the product extending therethrough;

restricting the first portion from withdrawing through the panel aperture with the at least partially separated tabs of the tag panel; and attaching the third panel segment to the first panel segment at a selectively variable location between the retention aperture and the first fold line to form a triangular tag assembly configuration surrounding the first portion of the product.

12. The method of claim 11, wherein inserting the first portion of the product through the stretchable aperture occurs substantially simultaneously with inserting the first portion of the product through the tag panel.

13. The method of claim 11, and further comprising folding the tag panel into a tent-like configuration.

14. The method of claim 13, and further comprising securing the tag panel in the tent-like configuration using adhesive.

15. The method of claim 11, and further comprising suspending the tag assembly with the inserted product from a retention mechanism.

* * * * *